US007774903B2

(12) United States Patent
Van Doorn

(10) Patent No.: US 7,774,903 B2
(45) Date of Patent: Aug. 17, 2010

(54) ROLLER GIN APPARATUS, METHOD AND SYSTEM

(75) Inventor: Donald Van Doorn, Savannah, GA (US)

(73) Assignee: Lummus Corporation, Savannah, GA (US)

( * ) Notice: Subject to any disclaimer, the term of this patent is extended or adjusted under 35 U.S.C. 154(b) by 966 days.

(21) Appl. No.: 11/464,908

(22) Filed: Aug. 16, 2006

(65) Prior Publication Data

US 2007/0062010 A1 Mar. 22, 2007

Related U.S. Application Data

(60) Provisional application No. 60/708,452, filed on Aug. 16, 2005, provisional application No. 60/755,215, filed on Dec. 30, 2005, provisional application No. 60/764,710, filed on Feb. 2, 2006.

(51) Int. Cl.
*D01B 1/04* (2006.01)

(52) U.S. Cl. ..... 19/48 R

(58) Field of Classification Search ..... 19/39, 19/48 R, 50–54
See application file for complete search history.

(56) References Cited

U.S. PATENT DOCUMENTS 4,262,390 A * 4/1981 Einglett et al. ..... 19/50
4,563,794 A * 1/1986 Beeland ..... 19/48 R
6,115,887 A * 9/2000 Riter ..... 19/48 R

* cited by examiner

*Primary Examiner*—Shaun R Hurley
(74) *Attorney, Agent, or Firm*—Smith, Gambrell & Russell

(57) ABSTRACT

A high speed roller gin for seed cotton with variable length fibers has its components defined in accordance with the formula RKBS<(2SR-2MD)*RKSS/GRSS where, the rotary knife circumferential blade (RKBS) spacing is less than 2-times the seed release distance from the tip of the stationary knife (SR) minus 2-times the minimum distance the seed surfaces are allowed to approach the tip of the stationary knife (MD) multiplied by the rotary knife surface speed (RKSS) and divided by the ginning roller surface speed (GRSS). A seed cotton infeed slide further limits the exposure of the seed directly against the tip of the stationary knife to reduce the ginning of the undesirable short fibers. A process for using such gins is also disclosed.

15 Claims, 2 Drawing Sheets

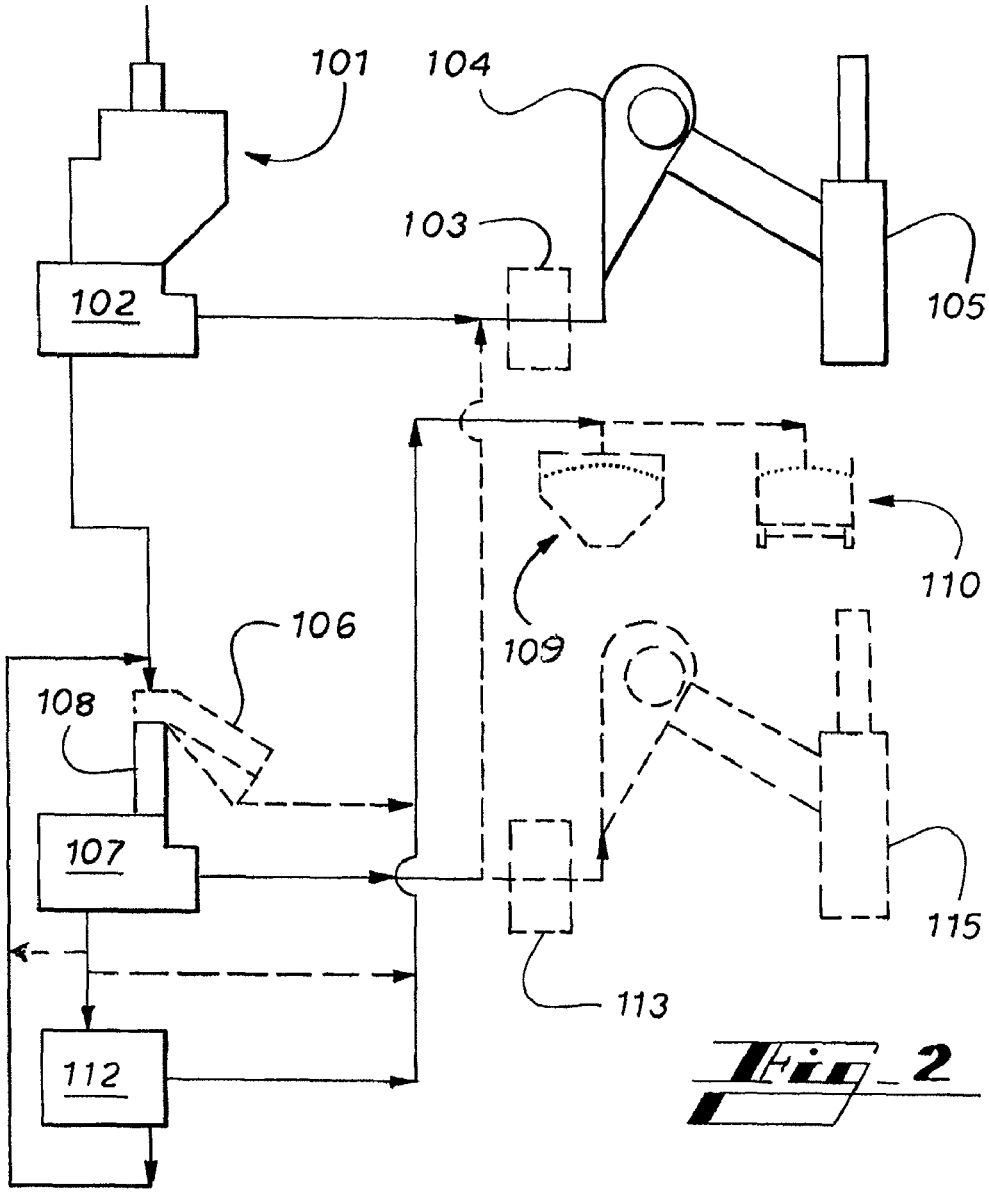
Fig. 2
Fig. 4
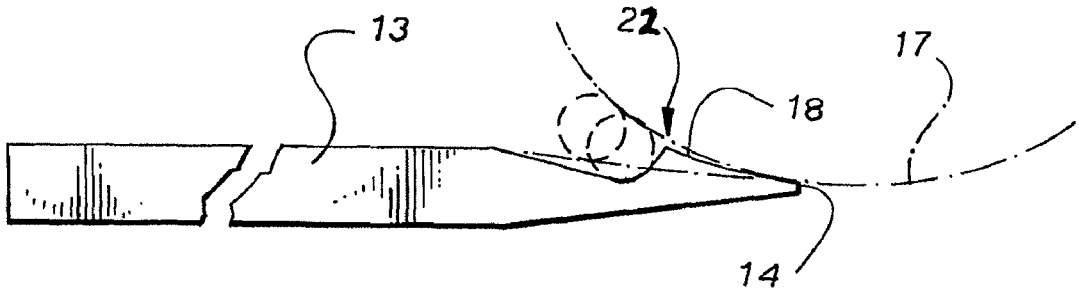

ROLLER GIN APPARATUS, METHOD AND SYSTEM

This application claims the benefit of U.S. provisional patent applications 60/708,452 filed Aug. 16, 2005, 60/755,215 filed Dec. 30, 2005 and 60/764,710 filed Feb. 2, 2006 which is relied on and incorporated herein by reference.

FIELD OF THE INVENTION

The present invention relates to ginning of cotton and especially to the ginning of Upland cotton in a roller gin apparatus. Roller ginning has heretofore been confined to extra long staple cottons such as the American Pima variety which have very few short fibers. Roller ginning as opposed to saw ginning is used on these varieties to preserve their extra fine spinning qualities, although the roller ginning process has been much slower and therefore more costly than saw ginning.

Current roller gins include three vital elements: a ginning roller covered with fibrous material, a stationary knife pressed against the ginning roller surface with considerable pressure, and a rotary knife about two and three-quarters inches in diameter having up to six radial blades equally spaced from each other. Seed cotton is dropped onto the surface of the rotating ginning roller, which carries the cotton to the stationary knife drawing the fibers under the edge of the knife. The knife edge strips back the seeds thus pulling the fibers from the seed. As the seeds accumulate on the edge of the stationary knife, the blades of the rotary knife periodically sweep the seeds away from the stationary knife.

The diameter of the rotary knife must be limited so that the tips of the blades of the knife move away from the surface of the stationary knife at a separation greater than the size of the cotton seeds at a distance from the fiber gripping point at the stationary knife tip that is less than the length of the desirable fibers, such that partially ginned seed will be drawn back to the tip of the stationary knife for further ginning. Thus the function of the rotary knife has been to sweep seeds that have been fully ginned away from the knife while allowing seeds that have desirable fiber remaining to be drawn back by those fibers to the stationary knife tip for further ginning.

Upland cotton contains many shorter fibers called linter fibers which are about $\frac{1}{8}^{th}$ inch long, as well as some intermediate length fibers. Current roller gin technology allows the seeds to be drawn directly to the tip of the stationary knife which allows the short fibers, on Upland cotton, to be pulled from the seed, thus making the quality of the cotton less valuable due to its short fiber content. The USDA ginning lab at Mesilla Park, N. Mex. has conducted experiments in an attempt to increase the ginning capacity of roller gins. These experiments have been successful to a large extent and they have been extended to include the ginning of Upland cotton, which is by far the majority of cottons grown around the world and are normally saw-ginned because of the much greater speed of saw ginning and because the quality of the Upland cotton for most uses has not been as crucial as for Pima type cottons. Although these experiments have demonstrated that Upland cottons may be roller ginned at much higher rates than previously thought possible with less fiber breakage, these experiments have not been able to fully overcome the problem of too many short fibers in Upland ginned cotton.

SUMMARY OF THE INVENTION

It is an object of the present invention to reconfigure the components and speeds of the current roller gins to control the distance the cotton seeds are held away from the fiber grip point at the tip of the stationary knife, thereby controlling the minimum length of the fiber ginned. A second object of this invention is to more uniformly gin the seed to reduce the amount of desirable fibers remaining on the seed exiting the process.

DESCRIPTION OF THE DRAWINGS

Apparatus embodying features claimed in the present invention are depicted in the Figures attached hereto wherein:

FIG. 2 is a flow chart of a system embodying the present invention with optional features.

FIG. 4 is a side elevational view showing another embodiment of the stationary knife as used in the present invention.

DESCRIPTION OF A PREFERRED EMBODIMENT

Figure 1:
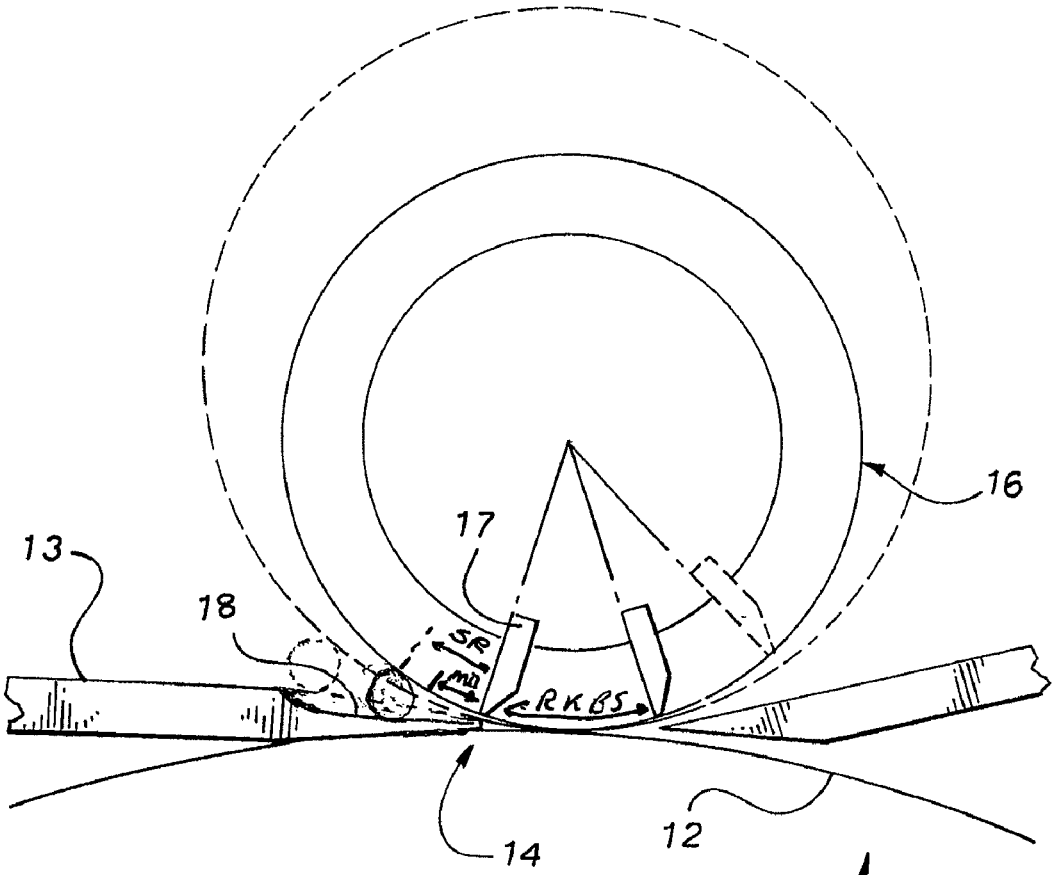
FIG. 1 is a schematic illustration of certain features of the present roller gin construction

It is well known that in the prior art the ginning roller R is approximately fifteen inches in diameter with a fibrous surface S which rotates towards the tip T of the stationary knife K, or counter clockwise in FIG. 1. A rotary knife RK is also rotated toward tip T in a clockwise rotation. The rotary knife RK has a plurality of blades B, normally six in number and is just under 3 inches in diameter. The relative surface speed of the rotary knife and ginning roller is offset, with the rotary knife rotating at a substantially lower "surface speed" relative to the ginning roller. For example, recent testing by the USDA indicated that optimal speed for a conventional rotary knife is about two hundred seventy rpm, whereas about 730 rpm would be required to match the surface speed of the ginning roller. The test showed that the increased fiber left on the seed in speeding up the rotary knife from the recommended 207 rpm speed to the 1:1 surface speed ratio with the ginning roller, leaves about 5 more pounds of unginned fiber per bale which is unsatisfactory. Referring to FIG. 1, note that a ginning roller 11 with a surface 12 is provided and may be identical to the prior art roller in construction and diameter. Stationary knife 13 is positioned adjacent surface 12 such that cotton fibers entrained on surface 12 are carried under the knife tip 14 but the seeds cannot pass beneath the knife. In one embodiment of stationary knife 13 in the present invention the upper surface 18 of the stationary knife 13 near the tip is reduced in thickness relative to a conventional knife such that the divergence between the knife surface and the arc of rotation of the blades of a cooperative rotary knife 16 is increased thus reducing the seed release distance from tip 14 for a particular size seed.

In an embodiment, the rotary knife 16 of the present invention is smaller in diameter than a conventional rotary knife, being less than about 5 centimeters in diameter, and has more blades 17 namely eight to twelve blades. In the illustrated embodiment twelve blades 17 are equidistantly distributed about the axis of the rotary knife 16. Knife 16 is mounted in conventional adjustable bearings so that it may be adjusted relative to the tip 14. Knife 16 is also rotated at a speed such that the speed of the tips of the knife blades more nearly match the speed of surface 12 of the ginning roller 11, thus a subsequent blade tip will pass the stationary knife as the surface of the roller moves relative to the stationary knife a distance of less than about 3 centimeters. As seed cotton is carried toward stationary knife tip 14 by the ginning roller 11, blades 17 engage the seed and carry it onto the upper surface of knife 13. As the knife surface and arc of rotation of blades 17 diverge the seed is released. This release point is selected in accordance with the desired length of the fiber such that if desirable fiber remains attached to the seed, the nip between the knife point 14 and ginning roller 12 still contains fiber, thus the seed is pulled back toward knife point 14 when released by blade 17. Unlike conventional roller gins, however, the seed is not permitted to return to the knife tip 14. Rather, the next knife blade 17 engages the seed and returns it to the release point thereby separating additional desirable fibers without allowing shorter fiber to be removed from the seed. If at that point desirable fiber remains attached to the seed and is engaged in the nip, the seed is again drawn back toward the nip until engaged by the next blade. The process continues until substantially all of the fiber of the desired length is removed and the seeds are released.

It may be seen with upland cotton that the amount of linter fiber and intermediate length fiber ginned with the desirable length fiber may be reduced greatly by selectively choosing the minimum approach to the tip of the stationary knife of the seed as it is drawn back toward the nip by the fiber. Simply put, the speed and spacing of the blades on the rotary knife are to be such that the seed cannot completely return to tip 14, thus the shorter fibers cannot be entrained on ginning roll surface 12 when the seed is drawn back toward the tip 14 by the longer fibers. Thus, primarily the longer fibers will be ginned and the shorter fibers will be left on the upland cotton seed for possible subsequent removal.

The limits of this feature of the proposed invention may be defined by the formula:

$$RKBS<2SR*RKSS/GRSS$$

Where, the rotary knife circumferential blade spacing (RKBS) is less than 2-times the seed release distance from the tip of the stationary knife (SR) multiplied by the rotary knife surface speed (RKSS) and divided by the ginning roller surface speed (GRSS).

This formula theoretically defines the limit of the conditions that assures that all the fiber separation from the seeds (ginning) occurs by the blades of the rotary knife pressing against the surfaces of the seeds once the seeds pass the tip of the stationary knife at entry. However to fully receive all the benefits of this feature of the present invention, the formula should read:

$$RKBS<(2SR-2MD)*RKSS/GRSS$$

Where Rotary knife circumferential blade spacing is less than 2-times the seed release distance from the tip of the stationary knife minus 2-times the minimum distance the seed surfaces are allowed to approach the tip of the stationary knife (MD) times the rotary knife surface speed divided by the ginning roller surface speed.

In these formulas all the factors, except one, can be easily measured. This factor is the seed release distance from the tip of the stationary knife. This must be determined empirically from tests of specific cultivars. Thus long staple cotton and shorter varieties will have different interstitial separation of the components to maximize recovery of the desirable fibers and minimize recovery of fibers of undesirable length. The obvious and important effect of too great a seed release distance is excessive unginned desirable fiber left on the seed. The release distance is not only influenced by the geometry of the components of the roller gin but also by the speed relationship between the rotary knife and the ginning roller. Tests with current roller ginning technology have shown that while increasing the speed of the rotary knife relative to the ginning roller increases ginning rate, the "carryover" (partially ginned seeds), increases to unacceptable levels The present invention reduces this problem by shortening the seed release distance from the nip point at the tip of the stationary knife. To accomplish this, the diameter of the rotary knife may be reduced, the stationary knife contour may be modified and the ginning roller diameter may be reduced.

As an example, assume a 2" diameter rotary knife with ten blades running at the same surface speed as the ginning roller and that there is no slippage between the fibers and the ginning roller The circumference of the rotary knife blades would be 6.3". With 10 blades, the circumferential distance between blade tips would be 0.63". As the rotary knife and ginning roller turn, the seed would move toward the stationary knife tip the same amount as the succeeding blade would move toward the seeds after the previous blade released the seeds. Therefore the seeds would move toward the tip of the stationary knife a distance of 0.315" before being contacted by the next blade. With these modifications, including a 2" diameter rotary knife and offset stationary knife, the release point of the seeds from the tip of the stationary knife could be set as close as approximately 0.50". Therefore the closest point the seeds could approach the tip of the stationary knife after the initial entry of the seeds would be 0.185 or greater by increasing the rotary knife speed relative to the ginning roller or moving the rotary knife relative to the stationary knife. Accordingly, fibers less than this length, such as found in Upland Cotton, would not be ginned with the longer more desirable fibers after the initial pass of the seed over the tip of the stationary knife.

FIG. 1 also shows the minimum seed release distances from the tip of the stationary knife with the current standard rotary knife outside diameter of approximately 2 ¾", shown in dotted line, as compared to the rotary knife diameter of approximately 2". In the figure the respective rotary knife diameters are moved up as close to the tip of the stationary knife as possible with the tips of the blades of the rotary knives just touching the surface of the ginning roller to minimize the seed release distances. FIG. 1 shows the effect of the modified stationary knife which is appreciable but limited by the practicality of the very thin tip of the stationary knife. It is to be understood that the smaller rotary knife may be moved relative to the tip of the stationary knife to increase the seed release distance from the tip of the stationary knife when ginning longer staple cottons.

Once the conditions have been established of the optimum design, settings and speeds of the apparatus of the present invention in which a fixed seed release distance from the tip of the stationary knife has been established, the nose of the stationary knife may be modified to assure that the blades of the rotary knife contact the seeds about midway of their width rather than higher up on the seed surface which might tend to crush the seed or abrade the surface of the seed. This modification shown in FIG. 4 has the stationary knife surface 18 adjacent rotary knife 17 thickened to follow the locus of the tips of the rotary knife blades 17 within one seed radius from the very tip of the stationary knife to the predetermined seed release point 22 where it abruptly releases the seed. This modification of the stationary knife 13 also virtually eliminates the effect of variable seed size on the release point of the seed. This is increasingly important as cotton seed breeders are introducing new cultivars with smaller seeds to increase cotton yields.

Another desirable outcome of the present invention is that the force pressing the ginning roller against the stationary knife is lessened when the fibers are merely held between the stationary knife and the ginning roller surface while the blades of the rotary knife "roll" the seed away from the fibers to cause ginning as compared with current technology ginning with the seed primarily stripped away from the fibers by the tip of the stationary knife. The high pressures required between the stationary knife and the ginning roller to obtain high capacity ginning with current technology generates greater amounts of heat in the ginning roller and accelerates wear of the fiber surface of the ginning roller which necessitates the use of additional means to keep the ginning roller from overheating including spraying atomized water onto the surface of the ginning roller. The lower pressures allowable with the present invention at least partially alleviate the need for artificial cooling of the ginning roller and extend the life of the ginning roller surface. Also the lower pressures reduce the power to drive the ginning roller. However, the invention would result in an increase in power to drive the rotary knife, but there would be a net reduction in overall power use. While this invention will primarily benefit the ginning of Upland cottons, important features of this invention will also benefit the ginning of extra long staple cottons.

Figure 3:
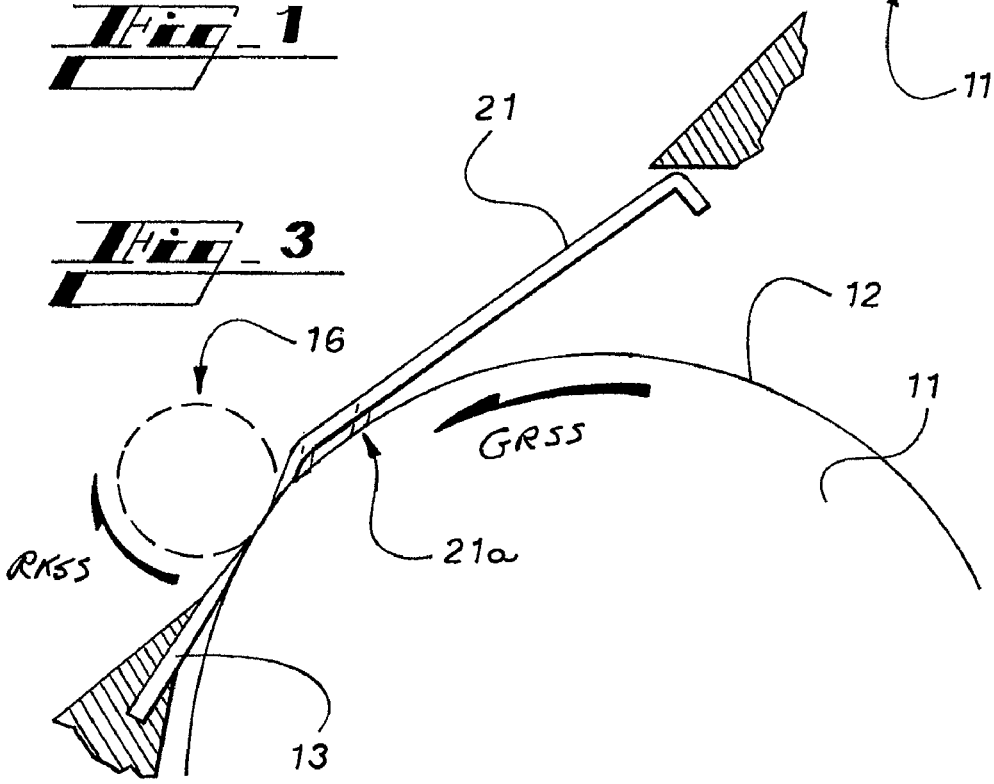
FIG. 3 is a second embodiment illustrating certain features of the present invention.

While the foregoing addresses means to control the minimum fiber length ginned after a blade of the rotary knife passes the tip of the stationary knife, the present invention may also include apparatus and means to reduce the time the seed cotton remains at the tip of the stationary knife prior to the first rotary knife blade passing the tip of the stationary knife. In the prior art, rotary knife roller gins feed at least some of the seed cotton onto the surface of the ginning roller several inches away from the stationary knife, thus allowing a significant amount of seed exposure directly against the tip of the a stationary knife before a rotary knife blade contacts the cotton resulting in the removal of much short fiber. Therefore in another embodiment of the present invention, a slide panel is incorporated which limits the distance and time the ginning roller surface movement can hold the seed cotton against the tip of the stationary knife before a blade of the rotary knife moves the seed away from said tip. The extreme limit of this application is shown in FIGS. 1 and 3. In this embodiment, seed cotton is fed into the gin from a novel slide panel 21 which terminates adjacent the rotary knife and ginning roller at a separation of less than one seed diameter from the rotary knife blade tips to force the seed cotton into the pockets between the rotary knife blades where the rotation of the rotary knife then exposes the seed cotton to the ginning roller at a minimum distance from the tip of the stationary knife. Note that the entry slide panel terminates at a thin edge and acute angle capable of being mounted with the edge within 4 mm of the surface of the ginning roller and the tips of said blades where said blade tips converge with said ginning roller surface.

Locating this slide panel in close proximity to the rotary knife creates additional advantages over current state of the art. Currently ginning rollers revolve at surface speeds considerably faster than rotary knife blade tip speeds. This, coupled with the distances the seed cotton travels on the ginning roller before reaching the rotary knife, causes the seed cotton to back up behind the blades of the rotary knife. Thus when a blade passes the tip of the stationary knife, this concentration of seed cotton instantly starts its ginning action which continues until the next blade sweeps the seeds away from the tip of the stationary knife. Consequently over ginning occurs before the seeds first pass beyond the tip of the stationary knife. With our slide panel set closely to the rotary knife, the seed cotton is fed to the ginning roller by the rotary knife blades. The smaller pockets of our rotary knives control the feed rate when the slide panel is set close to the rotary knife and feed small "batches" of cotton for more uniform and shorter exposure ginning action. Also less seed cracking occurs as the seed are less densely concentrated when the blades must converge on the tip of the stationary knife.

It may be advantageous to locate the end of the slide panel at a distance greater than one seed diameter from the rotary blade tips, as shown at 21*a*, to reduce the likelihood of seed breakage between the tips of the rotary knife blades and the slide panel. Other locations of the slide panel farther from the tips of the rotary knife blades can be empirically determined to reduce the ginning of short fiber while optimizing the ginning rate. Factors influencing the optimum slide panel location involve the seed cotton characteristics, the speeds of the rotary knife and ginning roller and the blade spacing on the rotary knife.

In current roller ginning there is invariably a certain amount of seeds that slip through the ginning process without being properly ginned. To prevent the loss of valuable fiber, seed "reclaimers" are used to pluck the seed with valuable fiber from the seed exiting the ginning process. This reclaimed seed is then passed back to join the seed cotton entering the ginning process. Unfortunately, these seed reclaimers pick up much already fully ginned seed that is entrained in the seed reclaimed with excess fiber. In current practice the entrainment of the well-ginned seed along with the reclaimed seed with fiber is ejected by the cleaners in the current feeders mounted over the gin stands whose function is to clean trash from the cotton seed as well as to uniformly feed the cotton seed to the gin stand. Additionally the recirculation of the already well-ginned seed is doubly damaging to our current invention as the re-ginning of the already adequately ginned seed increases the likelihood of the shorter fibers on these seeds increasing the short fiber content of the lint which is in direct opposition to the main object of this current invention.

In light of the above problems with current over-ginning system practices that are not conducive to reducing short fiber content, the current invention may include novel gin plant system designs to better preserve fiber staple length and uniformity. A central concept of this gin plant design is utilization of a first stage and second stage of ginning which are distinct from each other. Once the seed cotton is passed through the first stage, any further ginning needed is done in the second stage. This places different requirements on the first stage feeders as compared to the second stage feeders. The first stage feeders over the gin stands may be the traditional feeders whose function is not only to regulate the seed cotton being fed to the gin stands but to also clean the seed cotton with traditional screens and grids and extractors to remove trash while containing the fiber-covered seed cotton locks.

The feeders over the second stage gin stands in the present invention have different requirements. Presumably the partially ginned seed does not require additional cleaning and therefore the second stage feeders do not need the cleaning elements per se. On the other hand, to maintain a high lint uniformity index in the second stage requires that as many of those already sufficiently ginned seeds as possible should be removed prior to the second stage ginning. An efficient location for the second stage clean seed removal is at the entry to the feeder over the second stage gins. Therefore feeders for the second stage gins optimally might contain a clean seed separator feature along with metering means to deliver a uniform flow of the partially ginned seed cotton to the gin stand.

The second stage gin stands should utilize the features described herein above to minimize short fiber content albeit adjustments may be made to accommodate the different characteristic of the partially ginned seed.

Seeds exiting the second stage gin stand(s) may still contain excess desirable fiber. These seeds may be passed through a conventional seed reclaimer or a seed separator as described above before being returned to the feeder over the second stage gin stand(s).

Referring to FIG. 2 it may be seen that a ginning system employing the present invention may have the following components organized as described. A seed cotton feeder 101 with seed cotton cleaning features provides unginned seed cotton to a first gin stand 102 utilizing the features described hereinabove which separates lint cotton from the seeds. The separated lint passes through an optional lint cleaner 103 to a condenser 104 and then to a baling press 105. Cotton seed exiting first gin stand 102 is passed through a seed separator 106, which may be unlike current art "reclaimers" which entrain large amounts of well-ginned seed along with the "reclaimed" seed sent back for secondary ginning. The primary function of the "separator" in the present invention is to prevent the seed already adequately ginned from being ginned in a second stage ginning process when the highest quality fiber is the goal. The clean seed is passed from separator 106 to either seed storage 109 or seed shipment 110. The cotton seed retaining desirable lint is passed into a second gin stand 107 configured with the teaching hereinabove,. This second gin stand 107 may be fed with only a feed chute 108 with a metering device rather than a full feeder 101. This feed chute may also have seed separator 106 integrally mounted at its entry. Lint ginned at second gin stand 107 is sent to optional lint cleaner 103 and condenser 104 for baling in press 105 with lint from gin stand 102. Seeds from second gin stand 107 may pass into a second separator or reclaimer 112 where the seeds are separated with seed retaining sufficient desirable lint being returned to second gin stand 107 and cleaned seed being sent to seed storage or shipment. Alternatively seeds from gin stand 107 may be returned to separator 106 joining seeds from gin stand 102 to return to gin stand 107, thus to eliminate second seed separator 112.

Referring to FIG. 2 again, it may be seen that another ginning system employing the present invention may have the following components organized as follows: a seed cotton feeder 101 provides seed cotton to a first gin stand 102 utilizing the features of the present disclosure invention which separates a preponderance of the longer fibers from the seeds. The lint from this first gin is delivered to an optional lint cleaner 103 to a baling press 105. The partially ginned seeds from the first gin stand 102 are delivered to a second gin stand 107' through an optional separator 106 or feed chute 108. The second gin may be a roller gin or may be optionally a saw gin. If the second gin is a roller gin it may be followed by a seed reclaimer or seed separator with the lint delivered through an optional lint cleaner 113 to a second baling press 115 and the seed from the reclaimer or separator with sufficient fiber to warrant another ginning returned to the second gin stand 107. If the second gin stand 107 is a saw gin, the lint is delivered through optional lint cleaner 113 to second baling press 115. All the cleaned seeds are delivered to a common storage 109 or shipping facility 110.

While the present invention has been shown in multiple embodiments, it is not so limited but is limited only by the scope of the appended claims as properly construed.

What is claimed is:

1. A method for ginning cotton having various lengths of cotton fiber attached to the seed comprising the steps of:

a. Entraining the cotton fibers on a fibrous surface of a ginning roll rotating at a predetermined speed about a longitudinal axis thereof;

b. Creating a nip between said fibrous surface and a stationary knife extending longitudinally along said ginning roll such that fibers entrained on said fibrous surface are carried beneath a tip of said knife and movement of seed with said fibrous surface is arrested by said knife;

c. Urging said seed over said knife with a rotary knife having a plurality of longitudinally extending blades that entrap the seeds between successive ones of said plurality of blades and the top surface of said stationary knife, said rotary knife rotating in a direction counter to the rotation of said fibrous surface to separate entrained cotton fibers from said seed;

d. Releasing said seed as each blade of said plurality of blades moves away from said top surface at a predetermined seed release distance from said stationary knife tip such that seed having attached cotton fibers entrained within said nip are drawn back toward said stationary knife tip, e. Rotating said rotary knife at a speed sufficient that a subsequent blade thereof engages said seed at a point intermediate said seed release distance and said tip greater than the length of the shorter fibers on said seed.

2. A method as described in claim 1 further comprising coordinating the speed of said ginning roll and said rotary knife such that the surface of said ginning roll moves less than about 35 mm before a seed in contact with said stationary knife tip is contacted by said rotary knife.

3. In an apparatus for ginning cotton to gin substantially only longer cotton fibers, including a driven ginning roller, a stationary knife having a thin leading edge adjacent the moving circumferential surface of said ginning roller such that cotton fibers entrained on said ginning roller pass beneath said stationary knife, a driven rotary knife rotating adjacent said driven ginning roller and said leading edge of said stationary knife, the improvement comprising: said rotary knife having at least eight equally circumferentially spaced blades, with said blades and the surface of said ginning roller moving concomitantly toward said stationary knife edge at speeds such that each of said at least eight equally circumferentially spaced blades passes said knife edge during the same interval of time as not more than 40 millimeters of said driven ginning roller surface, whereby cotton seed having longer fibers remaining thereon are repetitively engaged by said blades at a distance displaced from said stationary knife edge greater than shorter fibers on said cotton seed such that the majority of the shorter fibers on said cottons seed are not ginned.

4. The improvement as claimed in claim 3 wherein said at least eight blades on said rotary knife are circumferentially spaced apart in accordance with the relation RKBS<2SR-2MD)*RKSS/GRSS where, the rotary knife circumferential blade spacing (RKBS) is less than 2-times the seed release distance from the tip of the stationary knife (SR) minus 2-times the minimum distance the seed surfaces are allowed to approach the tip of the stationary knife (MD) multiplied by the rotary knife surface speed (RKSS) and divided by the ginning roller surface speed (GRSS).

5. In an apparatus for ginning cotton to gin substantially only longer desirable cotton fibers, including a driven ginning roller, a stationary knife having a leading edge adjacent the moving surface of said ginning roller, a rotary knife having a plurality of substantially radial, equally spaced blades rotating adjacent said ginning roller and said leading edge of said stationary knife, the improvement comprising said rotary knife having at least eight radial blades, with said plurality of blades and the surface of said ginning roller moving concomitantly toward said stationary knife edge at a speed such that not more than 40 millimeters of said driven ginning roller surface pass said knife edge during the interval of time between the passage of each of said radial blades past said knife edge.

6. An apparatus for ginning cotton including:

a. a driven ginning roller, b. a stationary knife having a thin leading edge adjacent the periphery of said ginning roller, c. a rotary knife having a plurality of substantially equally spaced blades ending in uniform tips rotating adjacent said ginning roller and said leading edge of said stationary knife, d. a first surface defined on said stationary knife from the thin leading edge for a distance corresponding to a desired blade release point, said surface spaced less than one cotton seed diameter away from the arc defined by the tips of said radial blades rotating past said stationary knife, e. a second surface defined on said stationary knife and joining said first surface adjacent said rotary knife at said blade release point, said second surface steeply dropping away at least one cotton seed diameter from the arc defined by the tips of said radial blades, whereby said cotton seeds at said second surface are released by said radial blades.

7. An apparatus for ginning cotton including:

a. a ginning roller, b. a stationary knife having a thin leading edge adjacent the periphery of said ginning roller, c. a rotary knife having a plurality of substantially equally spaced blades ending in uniform tips rotating adjacent said ginning roller and said leading edge of said stationary knife, said tips of the blades defining a reduced thickness portion of the stationary knife from the thin leading edge for a distance corresponding to a desired blade release point, said reduced thickness portion spaced less than one cotton seed diameter away from the arc defined by the tips of said plurality of blades rotating past said stationary knife wherein said blades on said rotary knife are circumferentially spaced apart in accordance with the relation $$RKBS<(2SR-2MD)*RKSS/GRSS$$

where, the rotary knife circumferential blade spacing (RKBS) is less than 2-times the seed release distance from the tip of the stationary knife (SR)) minus 2-times the minimum distance the seed surfaces are allowed to approach the tip of the stationary knife (MD) multiplied by the rotary knife surface speed (RKSS) and divided by the ginning roller surface speed (GRSS).

8. A system for ginning cotton comprising one or more cotton ginning apparatus each including in a first stage a driven ginning roller, a stationary knife having a thin leading edge adjacent the moving circumferential surface of said ginning roller, a rotary knife having a plurality of substantially radial blades rotating adjacent said driven ginning roller and said leading edge of said stationary knife, the improvement comprising said rotary knife having at least eight blades, with said plurality of blades and the surface of said ginning roller moving concomitantly toward said stationary knife edge at speeds such that cotton fibers of not less than a predetermined length are ginned from seed cotton introduced onto said ginning roller with fibers of less than said predetermined length generally remaining unginned, a baling press for baling cotton fiber received from said first stage, one or more clean seed separators receiving cotton seed from said first stage of ginning apparatus and separating said cotton seed sufficiently ginned from said cotton seed having residual cotton fibers long enough for ginning being sent to a second stage of ginning apparatus which includes a driven ginning roller, a stationary knife having a thin leading edge adjacent the moving circumferential surface of said ginning roller, a rotary knife having a plurality of substantially equally spaced blades rotating adjacent said driven ginning roller and said leading edge of said stationary knife, the improvement comprising said rotary knife having at least eight blades, with said plurality of blades and the surface of said ginning roller moving concomitantly toward said stationary knife edge at speeds such that cotton fibers of not less than a predetermined length are ginned from seed cotton introduced onto said ginning roller whereby cotton seed bearing lint of a length long enough for ginning is repetitively ginned by said one or more second stage ginning apparatus to remove lint longer than a predetermined length for selective baling.

9. A method for ginning cotton having various lengths of fiber attached to the seed comprising the steps of:

a. Rotating a ginning roll having a fibrous surface at a predetermined speed about a longitudinal axis thereof;

b. Creating a nip between said fibrous surface and the tip of a stationary knife extending longitudinally along said ginning roll;

c. Introducing seed with fiber attached thereto onto said ginning roll at a selected distance from said nip such that fibers are entrained on said fibrous surface and carried beneath said tip of said knife and movement of seed with said fibrous surface is arrested by said knife;

d. Urging said seed over said knife with a rotary knife having a plurality of longitudinally extending blades rotating in a direction counter to the rotation of said fibrous surface to separate entrained cotton fibers from said seed;

e. Releasing said seed at a seed release distance from said knife tip such that seed having attached long fibers entrained within said nip are drawn back toward said tip; and, f. Rotating said rotary knife at a speed sufficient that a subsequent blade thereof engages said seed at a point intermediate said seed release distance and a distance from said tip greater than the length of the shorter fibers on said seed.

10. An apparatus for ginning cotton to gin substantially only longer cotton fibers including:

a a ginning roller, b. a stationary knife having a thin leading edge adjacent the periphery of said ginning roller, c. rotary knife having a plurality of substantially equally spaced blades ending in uniform tips rotating adjacent said ginning roller and said leading edge of said stationary knife defining a reduced thickness portion of the stationary knife from the leading edge for a distance corresponding to a desired blade release point, said reduced thickness portion spaced less than one cotton seed diameter away from the arc defined by the tips of said radial blades rotating past said stationary knife, and d. a variably positionable feed slide panel for introducing seed with fibers thereon to said ginning roller at a predetermined distance from said rotary knife less than 40 mm.

11. An apparatus for ginning cotton to gin substantially only longer cotton fibers including:

a. a ginning roller upon which cotton fibers are entrained;

b. a stationary knife with a thin leading edge adjacent said roller to engage seed attached to said cotton fibers;

c. a rotary knife with a plurality of substantially equally spaced blades, said knives proximate each other and said ginning roller and rotated at a speed sufficient to carry said seed over said knife leading edge and iteratively release said seed for movement toward said knife edge for so long as fiber of a predetermined length remains attached to said seed and entrained on said roller;

d. a seed cotton slide panel to feed cotton to said apparatus inclined downwardly toward the surface of said ginning roller at said rotary knife, said slide panel terminating within 40 mm of said rotary knife.

12. Apparatus as in claim 11 in which said slide panel terminates at a thin edge and acute angle capable of being mounted with the edge within 4 mm of the surface of the ginning roller and the tips of said blades where said blades converge with said ginning roller surface.

13. Apparatus as in claim 12 in which a cotton carrying side of said slide panel adjacent said rotary knife is tangential to the circumference of said rotary knife at said thin edge of the slide panel and the distance between said carrying side and said blade tips gradually increases with distance away from said thin edge to minimize seed cracking in operation as said blades converge against said carrying side.

14. The improvement as claimed in claim 3 wherein said blades on said rotary knife are circumferentially spaced apart in accordance with the relation RKBS<(2SR)*RKSS/GRSS where, the rotary knife circumferential blade (RKBS) spacing is less than 2-times the seed release distance from the tip of the stationary knife (SR) multiplied by the rotary knife surface speed (RKSS) and divided by the ginning roller surface speed (GRSS).

15. Apparatus for ginning cotton including a ginning roller, a stationary knife having a thin leading edge adjacent the periphery of said ginning roller, a rotary knife having a plurality of substantially radial blades ending in uniform tips rotating adjacent said ginning roller and said leading edge of said stationary knife, said tips of the blades defining a reduced thickness portion of the stationary knife from the thin leading edge for a distance corresponding to a desired blade release point, said reduced thickness portion spaced less than one cotton seed radius away from the arc defined by the tips of said radial blades rotating past said stationary knife wherein said blades on said rotary knife are circumferentially spaced apart in accordance with the relation RKBS<(2SR)*RKSS/GRSS where, the rotary knife circumferential blade (RKBS) spacing is less than 2-times the seed release distance from the tip of the stationary knife (SR) multiplied by the rotary knife surface speed (RKSS) and divided by the ginning roller surface speed (GRSS).

* * * * *